US009245729B2

(12) United States Patent
Nakazato

(10) Patent No.: US 9,245,729 B2
(45) Date of Patent: Jan. 26, 2016

(54) DISCHARGE LAMP AND VEHICLE LAMP

(71) Applicant: Toshiba Lighting & Technology Corporation, Yokosuka-shi, Kanagawa-ken (JP)

(72) Inventor: Keisuke Nakazato, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/493,415

(22) Filed: Sep. 23, 2014

(65) Prior Publication Data

US 2015/0179422 A1 Jun. 25, 2015

(30) Foreign Application Priority Data

Dec. 20, 2013 (JP) ..... 2013-264143
Aug. 28, 2014 (JP) ..... 2014-174516

(51) Int. Cl.

| | |
|---|---|
| ***H01J 17/16*** | (2012.01) |
| ***H01J 61/073*** | (2006.01) |
| ***H01J 61/12*** | (2006.01) |
| ***H01J 61/82*** | (2006.01) |
| ***H01J 61/16*** | (2006.01) |
| ***H01J 61/34*** | (2006.01) |

(52) U.S. Cl.

CPC ..... *H01J 61/0732* (2013.01); *H01J 61/125* (2013.01); *H01J 61/16* (2013.01); *H01J 61/34* (2013.01); *H01J 61/827* (2013.01)

(58) Field of Classification Search

CPC ..... H01J 61/827; H01J 61/125
USPC ..... 313/623, 634, 637, 567
See application file for complete search history.

(56) References Cited

U.S. PATENT DOCUMENTS

| | | | | |
|---|---|---|---|---|
| 6,404,129 | B1 | 6/2002 | Hendricx et al. | |
| 7,098,596 | B2 | 8/2006 | Takagaki et al. | |
| 8,193,711 | B2 | 6/2012 | Deguchi et al. | |
| 8,836,217 | B2 | 9/2014 | Kato | |
| 2003/0057836 | A1 * | 3/2003 | Koenigsberg et al. | 313/634 |
| 2004/0150344 | A1 | 8/2004 | Takagaki et al. | |
| 2006/0119273 | A1 * | 6/2006 | Nakazato | H01J 61/33 313/634 |
| 2009/0206766 | A1 | 8/2009 | Uemura et al. | |
| 2010/0045184 | A1 | 2/2010 | Deguchi et al. | |
| 2010/0109528 | A1 * | 5/2010 | Shirakawa | 313/623 |
| 2014/0042889 | A1 | 2/2014 | Haacke et al. | |
| 2014/0125224 | A1 | 5/2014 | Kato | |

FOREIGN PATENT DOCUMENTS

| | | | |
|---|---|---|---|
| EP | 2086001 | A1 | 8/2009 |
| EP | 2091304 | A1 | 8/2009 |

(Continued)

OTHER PUBLICATIONS

May 28, 2015—(EP) Extended European Search Report—App 14185749.0.

*Primary Examiner* — Vip Patel
(74) *Attorney, Agent, or Firm* — Banner & Witcoff, Ltd.

(57) ABSTRACT

According to one embodiment, a discharge lamp includes a light-emitting part including a discharge space therein in which a metal halide and a gas are sealed, and a pair of electrodes which protrude toward an inside of the discharge space and are arranged to face each other while separated by a specified distance. Power consumption at a time of stable lighting is 20 W or more and 30 W or less. When a pressure of the gas sealed in the discharge space is X (atm), and a distance between a center axis of the electrodes and a surface of the metal halide is m (mm), a following expression is satisfied: $0.085 \leq m/X \leq 0.12$.

19 Claims, 3 Drawing Sheets

(56) References Cited

FOREIGN PATENT DOCUMENTS

| | | | |
|---|---|---|---|
| EP | 2725604 | A1 | 4/2014 |
| JP | 2004-172056 | A | 6/2004 |
| JP | 2012-038612 | A | 2/2012 |
| WO | 0067294 | A1 | 11/2000 |
| WO | 2012147014 | A2 | 11/2012 |
| WO | 2012-176493 | A1 | 12/2012 |

* cited by examiner

DISCHARGE LAMP AND VEHICLE LAMP

CROSS-REFERENCE TO RELATED APPLICATIONS

This application is based upon and claims the benefit of priority from Japanese Patent Application No. 2013-264143, filed on Dec. 20, 2013 and Japanese Patent Application No. 2014-174516, filed on Aug. 28, 2014; the entire contents of which are incorporated herein by reference.

FIELD

Embodiments described herein relate generally to a discharge lamp and a vehicle lamp.

BACKGROUND

In recent years, a discharge lamp which does not use mercury and has low power consumption is requested from the viewpoint of environment. However, when mercury is not used and power consumption is low, there is a fear that the discharge becomes unstable or brightness becomes insufficient.

In this case, if the pressure of an inert gas sealed in the discharge space of a light-emitting part of the discharge lamp is increased, the brightness of the discharge lamp can be improved.

Besides, if the size of the light-emitting part is decreased, the brightness of the discharge lamp can be improved.

However, if the pressure of the inert gas sealed in the discharge space of the light-emitting part is increased, although the required brightness can be secured, a new problem arises that the arcuate discharge becomes liable to be deflected up and down by mechanical vibration.

When the arcuate discharge becomes liable to be deflected up and down by the mechanical vibration, there is a fear that flicker occurs in luminous intensity distribution, or a metal halide sealed in the discharge space is flung up and emission color changes.

Besides, if the size of the light-emitting part is decreased, since the distance between the arcuate discharge deflected downward and the metal halide becomes short, the emission color becomes more liable to change.

Then, the development of a discharge lamp is desired which can secure required brightness even at low power consumption (for example, power consumption at the time of stable lighting is 20 W or more and 30 W or less), and the deflection of discharge can be suppressed.

DETAILED DESCRIPTION

Figure 1:
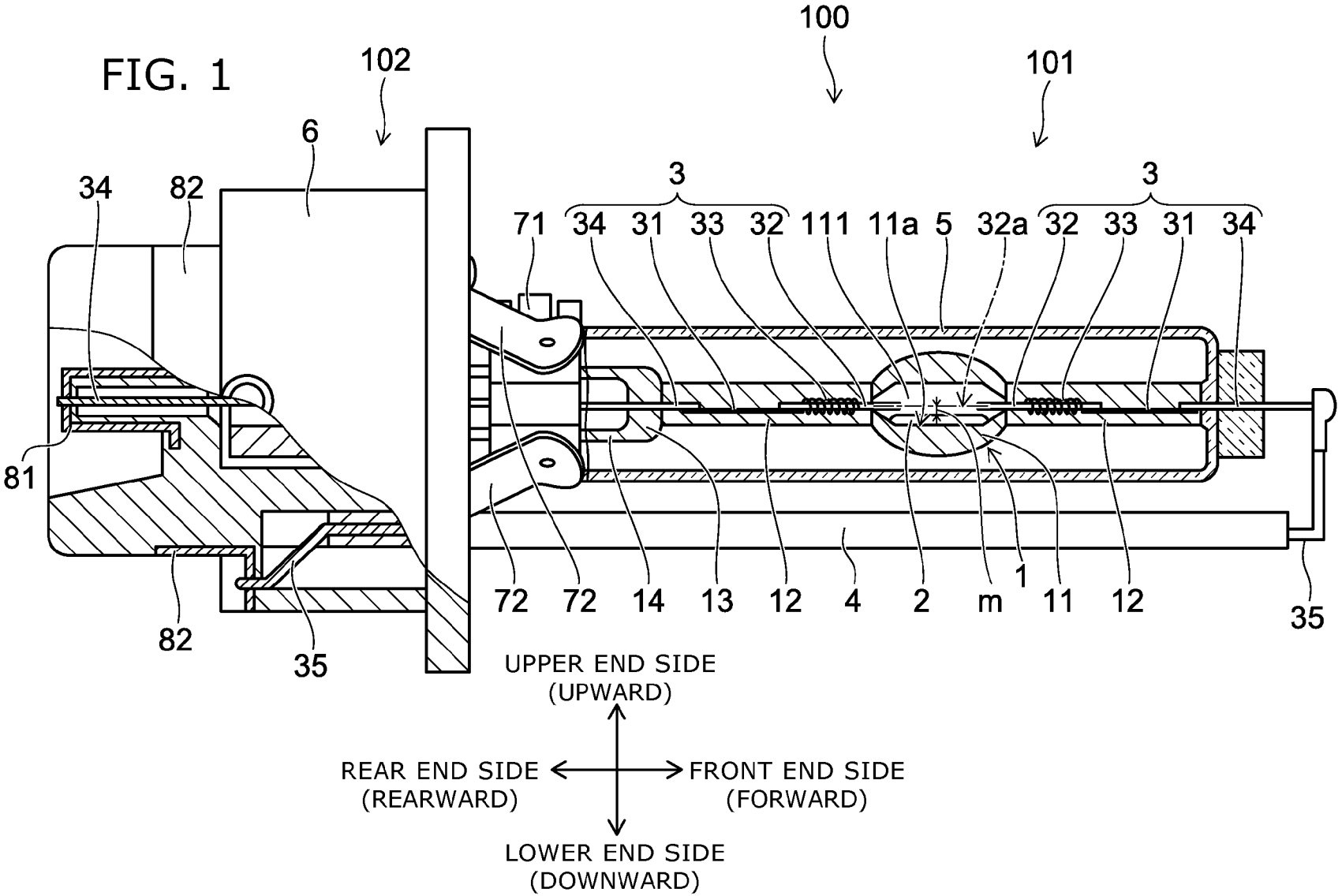
FIG. 1 is a schematic view for exemplifying a discharge lamp of an embodiment.

In general, according to one embodiment, a discharge lamp includes a light-emitting part including a discharge space therein in which a metal halide and a gas are sealed, and a pair of electrodes which protrude toward an inside of the discharge space and are arranged to face each other while separated by a specified distance.

Power consumption at a time of stable lighting is 20 W or more and 30 W or less.

When a pressure of the gas sealed in the discharge space is X (atm), and a distance between a center axis of the electrodes and a surface of the metal halide is m (mm), a following expression is satisfied: $0.085 \leq m/X \leq 0.12$.

According to the discharge lamp, although the power consumption is low, required brightness can be secured, and deflection of discharge can be suppressed.

Besides, in the discharge lamp, $0.10 \leq m/X \leq 0.12$ may be satisfied.

When doing so, the deflection of the discharge can be further suppressed.

Besides, the gas sealed in the discharge space is a xenon gas or a mixed gas mainly including the xenon gas.

Besides, according to another embodiment, a vehicle lamp includes the foregoing discharge lamp and a lighting circuit electrically connected to the discharge lamp.

According to the vehicle lamp, even if mechanical vibration due to the running of an automobile is applied to the discharge lamp, the occurrence of flicker in luminous intensity distribution and the change of emission color can be suppressed.

Besides, required brightness can be obtained immediately after lighting.

In this case, the discharge lamp can be attached so that the pair of electrodes provided in the discharge lamp are horizontal.

Hereinafter, an embodiment will be described with reference to the drawings. Incidentally, in the respective drawings, the same components are denoted by the same reference numerals, and a detailed description thereof is suitably omitted.

A discharge lamp of the embodiment is, for example, a HID (High Intensity Discharge) lamp used as a headlight of an automobile. Besides, when the discharge lamp is the HID lamp used as the headlight of the automobile, so-called horizontal lighting can be performed. Incidentally, although use of the discharge lamp of the embodiment is not limited to the headlamp of the automobile, here, as an example, the description will be made while using the example in which the discharge lamp is the HID lamp used as the headlamp of the automobile.

FIG. 1 is a schematic view for exemplifying a discharge lamp 100 of the embodiment.

Incidentally, in FIG. 1, when the discharge lamp 100 is attached to an automobile, a forward direction is a front end side, the opposite direction is a rear end side, an upward direction is an upper end side, and a downward direction is a lower end side.

As shown in FIG. 1, the discharge lamp 100 includes a burner 101 and a socket 102.

The burner 101 includes an inner pipe 1, an outer pipe 5, an electrode mount 3, a support wire 35, a sleeve 4 and a metal band 71.

The inner pipe 1 includes a light-emitting part 11, a sealing part 12, a boundary part 13 and a cylindrical part 14.

The inner pipe 1 is made of a material having transparency and heat resistance. The inner pipe 1 can be made of, for example, quartz glass.

The light-emitting part 11 has an elliptical sectional shape and is provided in the vicinity of the center of the inner pipe 1. A discharge space 11 in which a center portion is columnar and both ends are narrowed in taper shapes is provided inside the light-emitting part 11.

A discharge medium is sealed in the discharge space 111. The discharge medium includes a metal halide 2 not including mercury and a specified inert gas.

That is, the light-emitting part 11 includes therein the discharge space 111 in which the metal halide 2 not including mercury and the specified inert gas are sealed.

The metal halide 2 includes a halide of sodium, scandium, zinc, indium or the like. As halogen, for example, iodine can be exemplified. Bromine or chlorine can also be used instead of iodine.

Incidentally, from the viewpoint of environment, the metal halide 2 does not include mercury.

The gas sealed in the discharge space 111 is, for example, a gas including xenon.

The gas including xenon is a single gas of xenon or a mixed gas mainly including the xenon gas. The mixed gas mainly including the xenon gas is, for example, a mixed gas including a xenon gas of 70 vol % or more. A gas mixed with the xenon gas is, for example, an argon gas.

Incidentally, the details of pressure X of the gas sealed in the discharge space 111 will be described later.

Besides, in the specification, the pressure X (atm) of the gas sealed in the discharge space 111 is the pressure at room temperature (25° C.).

The sealing part 12 has a plate shape, and is provided at both ends of the light-emitting part 11. The sealing part 12 can be formed by using, for example, a pinch seal method. Incidentally, the sealing part 12 may be formed by a shrink seal method and may have a columnar shape.

The cylindrical part 14 is continuously formed through the boundary part 13 at the end of the sealing part 12 opposite to the light-emitting part 11 side.

The outer pipe 5 is provided outside the inner pipe 1 and concentrically with the inner pipe 1. That is, a double pipe structure is provided.

The connection between the outer pipe 5 and the inner pipe 1 can be performed by welding the outer pipe 5 to the vicinity of the cylindrical part 14 of the inner pipe 1. The gas is sealed in a closed space formed between the inner pipe 1 and the outer pipe 5. The gas to be sealed is a gas capable of dielectric barrier discharge, for example, one kind of gas selected from neon gas, argon gas, xenon gas and nitrogen gas or a mixed gas of these. The sealing pressure of the gas is preferably, for example, 0.3 atm or less at room temperature (25° C.), and more preferably 0.1 atm or less.

The outer pipe 5 is preferably made of a material having a thermal expansion coefficient close to that of the material of the inner pipe 1 and ultraviolet ray shielding property. The outer pipe 5 can be made of, for example, quartz glass added with oxide of titanium, cerium, aluminum or the like.

The electrode mount 3 is provided inside the sealing part 12.

The electrode mount 3 includes a metal foil 31, an electrode 32, a coil 33 and a lead wire 34.

The metal foil 31 has a thin plate shape and is made of, for example, molybdenum.

The electrode 32 has a columnar shape and is made of, for example, so-called thoriated tungsten in which tungsten is doped with thorium oxide. Incidentally, material of the electrode 32 may be pure tungsten, doped tungsten or rhenium tungsten.

One end of the electrode 32 is welded to an end part of the metal foil 31 at the light-emitting part 11 side. The other end of the electrode 32 protrudes into the discharge space 111. The electrodes 32 are arranged so that the tip ends face each other with a specified distance therebetween.

That is, the pair of electrodes 32 protrude into the inside of the discharge space 111, and are arranged to face each other with the specified distance.

The distance between the tip ends of the electrodes 32 can be made, for example, 3.7 mm or more and 4.4 mm or less.

The distance between a center axis 32*a* of the electrodes 32 and the inner wall of the light-emitting part 11 can be made 0.9 mm or more and 1.2 mm or less.

Distance m (mm) between the center axis 32*a* of the electrodes 32 and the surface (upper surface) of the metal halide 2 is the distance obtained by subtracting the thickness of the metal halide 2 from the distance between the center axis 32*a* of the electrodes 32 and the inner wall of the light-emitting part 11.

The thickness of the metal halide 2 is adjusted from the viewpoint of after-mentioned suppression of deflection of discharge and optical and electrical characteristics, and can be made 1.0 μm or more than 100 μm or less. The thickness of the metal halide 2 can be measured by, for example, taking an X-ray picture of the light-emitting part 11 of the discharge lamp 100 which is arranged horizontally.

Incidentally, the details relating to the distance m (mm) between the center axis 32*a* of the electrodes 32 and the surface (upper surface) of the metal halide 2 will be described later.

The shape of the electrode 32 may not be the columnar shape in which the diameter is constant in the axial direction. For example, the shape of the electrode 32 may be a non-columnar shape in which the diameter of the tip part is larger than the diameter of the base end part. Besides, the tip may be a sphere, or the shape may be such that like a DC lighting type, a diameter of one electrode and a diameter of the other electrode are different from each other.

The coil 33 can be formed of, for example, a metal wire made of doped tungsten. The coil 33 is wound around the outside of the electrode 32 provided inside the sealing part 12. In this case, for example, the wire diameter of the coil 33 is 30 μm or more and 100 μm or less, and the coil pitch can be made 600% or less.

The lead wire 34 can be made a metal wire made of, for example, molybdenum. One end of the lead wire 34 is placed on an end part of the metal foil 31 at the opposite side to the light-emitting part 11 side. The other end of the lead wire 34 extends until the outside of the inner pipe 1.

The support wire 35 has an L shape and is connected to the end part of the lead wire 34 extending from the front end side of the discharge lamp 100. The connection between the support wire 35 and the lead wire 34 can be performed by laser welding. The support wire 35 can be made of, for example, nickel.

The sleeve 4 covers a portion of the support wire 35 extending in parallel to the inner pipe 1. The sleeve 4 has, for example, a cylindrical shape and is made of ceramic.

The metal band 71 is fixed to the outer peripheral surface of the outer pipe 5 at the rear end side.

The socket 102 includes a main body part 6, an attachment fitting 72, a bottom terminal 81 and a side terminal 82.

The main body part 6 is made of an insulation material such as resin. A lead wire 34, a support wire 35 and a rear end side of the sleeve 4 are provided inside the main body part 6.

The attachment fitting 72 is provided at the end part of the main body part 6 at the front end side. The attachment fitting 72 protrudes from the main body part 6 and holds the metal band 71. The attachment fitting 72 holds the metal band 71 so that the burner 101 is held by the socket 102.

The bottom terminal 81 is provided inside the main body part 6 at the rear end side. The bottom terminal 81 is made of a conductive material and is electrically connected to the lead wire 34.

The side terminal 82 is provided at a side wall of the main body part 6 at the rear end side. The side terminal 82 is made of a conductive material and is electrically connected to the support wire 35.

Connection to a lighting circuit 205 (see FIG. 3) is made so that the bottom terminal 81 is the high voltage side, and the side terminal 72 is the low voltage side. In the case of a headlight of an automobile, the discharge lamp 100 is attached such that the center axis of the discharge lamp 100 is almost horizontal, and the support wire 35 is positioned almost at the lower end side (downward). Lighting of the discharge lamp 100 attached in such direction is called horizontal lighting.

Here, for example, the discharge lamp 100 used as the headlight of the automobile is requested to become bright immediately after lighting from the viewpoint of safety.

Hitherto, since the metal halide 2 includes mercury, the lamp can be made bright immediately after lighting.

However, in recent years, the metal halide 2 does not include mercury from the viewpoint of environment.

Thus, to make bright immediately after lighting is difficult.

Besides, in recent years, power consumption of the discharge lamp 100 is reduced from the viewpoint of environment. For example, hitherto, although the power consumption at the time of stable lighting is about 35 W, the power consumption is reduced to 20 W or more and 30 W or less.

Thus, there is a fear that the discharge becomes unstable or the brightness becomes insufficient.

According to the knowledge obtained by the the inventor, if the pressure X of the gas sealed in the discharge space 111 of the light-emitting part 11 is increased, the brightness of the discharge lamp 100 can be improved.

However, if the pressure X of the sealed gas is increased, there arises a new problem that arcuate discharge becomes liable to be deflected up and down by mechanical vibration due to the running of the automobile in which the discharge lamp 100 is provided.

When the arcuate discharge becomes liable to be deflected up and down by the mechanical vibration, there is a fear that flicker occurs in luminous intensity distribution, or the metal halide 2 sealed in the discharge space 111 is flung up and emission color changes. When the emission color becomes liable to change, the commodity value of the discharge lamp 100 is remarkably reduced.

Besides, if the size of the light-emitting part 11 is decreased, the brightness of the discharge lamp can be improved.

However, if the size of the light-emitting part 11 is decreased, the distance m between the center axis 32*a* of the electrodes 32 and the surface of the metal halide 2 becomes short.

Thus, when the arcuate discharge is deflected downward, the arcuate discharge and the metal halide 2 become liable to contact each other. As a result, the metal halide 2 sealed in the discharge space 111 becomes further liable to be flung up.

As a result of further consideration, the inventor developed the discharge lamp which can secure required brightness even if mercury is not used and power consumption is low, and the deflection of discharge can be suppressed.

Hereinafter, the knowledge obtained by the inventor will be described.

As described above, the brightness and the easiness of deflection of discharge depend on the pressure X of the gas sealed in the discharge space 111.

That is, if the pressure of the sealed gas is reduced, the deflection of discharge can be suppressed. However, if the pressure X of the sealed gas is reduced, the brightness becomes insufficient.

On the other hand, if the pressure X of the sealed gas is increased, required brightness can be secured. However, if the pressure X of the sealed gas is increased, the deflection of discharge becomes large.

Besides, if the distance m between the center axis 32*a* of the electrodes 32 and the surface of the metal halide 2 is shortened, the metal halide 2 becomes liable to be flung up. Thus, the emission color becomes liable to change.

On the other hand, if the distance m between the center axis 32*a* of the electrodes 32 and the surface of the metal halide 2 is lengthened, there is a fear that the intensity of the light-emitting part 11 becomes excessively low.

Besides, it appears that the brightness and the easiness of deflection of discharge are influenced by the kind of gas sealed in the discharge space 111 and the mixture ratio.

However, the sealed gas is limited to an inert gas such as xenon gas. Besides, even when the mixed gas is used, the combination is limited to inert gases like xenon gas and argon gas.

Thus, the influence of the kind and the mixture ratio of gases sealed in the discharge space 111 is small.

For example, a single gas of xenon and a mixed gas mainly including xenon gas (for example, the mixed gas of xenon gas and argon gas in which the xenon gas is 70 vol % or more) are comparable to each other in brightness and easiness of deflection of discharge.

Besides, it appears that the easiness of deflection of discharge is influenced by the distance between the tip ends of the electrodes 32.

However, since the distance between the tip ends of the electrodes 32 is regulated by a standard, the distance between the tip ends of the electrodes 32 is limited.

Thus, the influence of the distance between the tip ends of the electrodes 32 is small.

Besides, it appears that the brightness is influenced by the component ratio of the metal halide 2.

However, when mercury which most influences the brightness is not included, the influence of the component ratio of the metal halide 2 is small.

According to the knowledge obtained by the inventor, if the ratio (m/X) of the distance m between the center axis 32*a* of the electrodes 32 and the surface of the metal halide 2 to the pressure X of the gas is within a specified range, the required brightness can be secured even if mercury is not used and the power consumption is low, and the deflection of discharge can be suppressed.

Table 1 is a table showing results of an experiment performed by the inventor.

The experiment was performed under the following conditions.

Power consumption was 25 W.

In this case, control was made using an electrical ballast so that power consumption was 60 W at the time of start of lighting and was 25 W at the time of stable lighting.

The gas sealed in the discharge space 111 was a single gas of xenon.

The distance between the tip ends of the electrodes 32 was about 3.7 mm.

The metal halide 2 includes scandium iodide and does not include mercury.

Change of emission color was visually observed.

With respect to light flux immediately after lighting, the light flux after four seconds from the start of lighting was measured, and the quality was determined based on whether or not the light flux became 1000 lm or more.

TABLE 1

| m/X | change of emission color | light flux immediately after lighting |
|---|---|---|
| 0.125 | ◎ | defective |
| 0.120 | ◎ | excellent |
| 0.110 | ◎ | excellent |
| 0.105 | ◎ | excellent |
| 0.100 | ◎ | excellent |
| 0.098 | ○ | excellent |
| 0.096 | ○ | excellent |
| 0.090 | ○ | excellent |
| 0.085 | ○ | excellent |
| 0.083 | X | excellent |

◎: no change,
○: small change,
X: large change

As is apparent from Table 1, if the ratio (m/X) of the distance m to the pressure X is made excessively large, even if the emission color does not change, the required light flux can not be secured.

That is, if the ratio (m/X) of the distance m to the pressure X is made excessively large, although the deflection of discharge can be suppressed, the required brightness can not be secured.

Besides, if the ratio (m/X) of the distance m to the pressure X is made excessively small, even if the required light flux can be secured, the emission color changes.

That is, if the ratio (m/X) of the distance m to the pressure X is made excessive small, even if the required light flux can be secured, the deflection of discharge becomes large.

In this case, as is understood from Table 1, if $0.085 \leq m/X \leq 0.12$ is satisfied, the required brightness can be secured even if mercury is not used and power consumption is low, and the deflection of discharge can be suppressed.

Besides, as is understood from Table 1, if $0.10 \leq m/X \leq 0.12$ is satisfied, the deflection of discharge can be further suppressed.

Next, a vehicle lamp 200 including the discharge lamp 100 of the embodiment will be exemplified.

Figure 2:
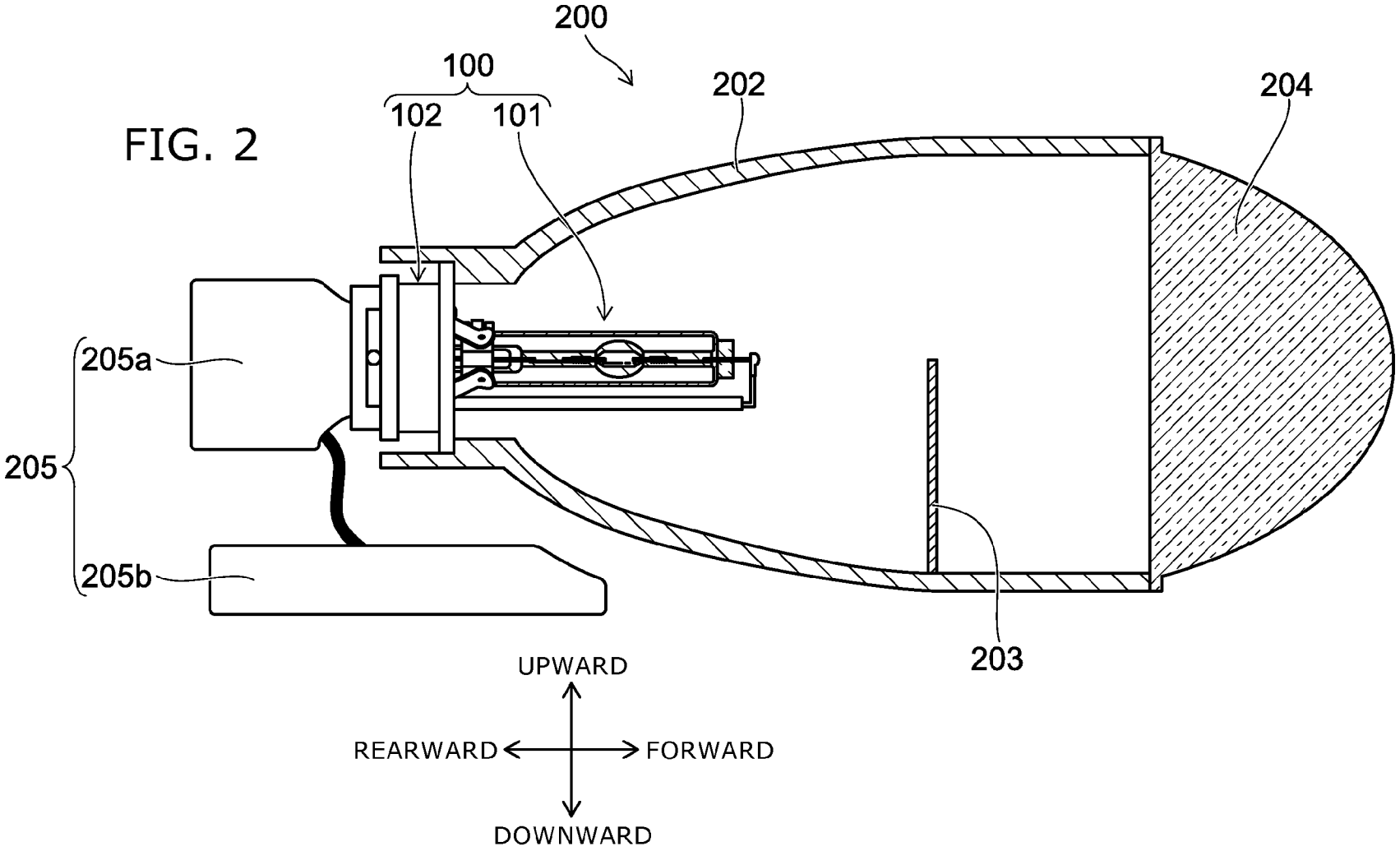
FIG. 2 is a schematic view for exemplifying a structure of a vehicle lamp.

FIG. 2 is a schematic view for exemplifying a structure of the vehicle lamp 200.

Incidentally, "forward" in FIG. 2 is the forward of an automobile to which the discharge lamp 100 is attached, "rearward" is the rearward of the automobile to which the discharge lamp 100 is attached, "upward" is the upward of the automobile to which the discharge lamp 100 is attached, and "downward" is the downward of the automobile to which the discharge lamp 100 is attached.

FIG. 2 shows a case where the discharge lamp 100 is attached so that the pair of electrodes 32 provided in the discharge lamp 100 are horizontal. That is, the case of the discharge lamp 100 in which horizontal lighting is performed is exemplified.

Figure 3:
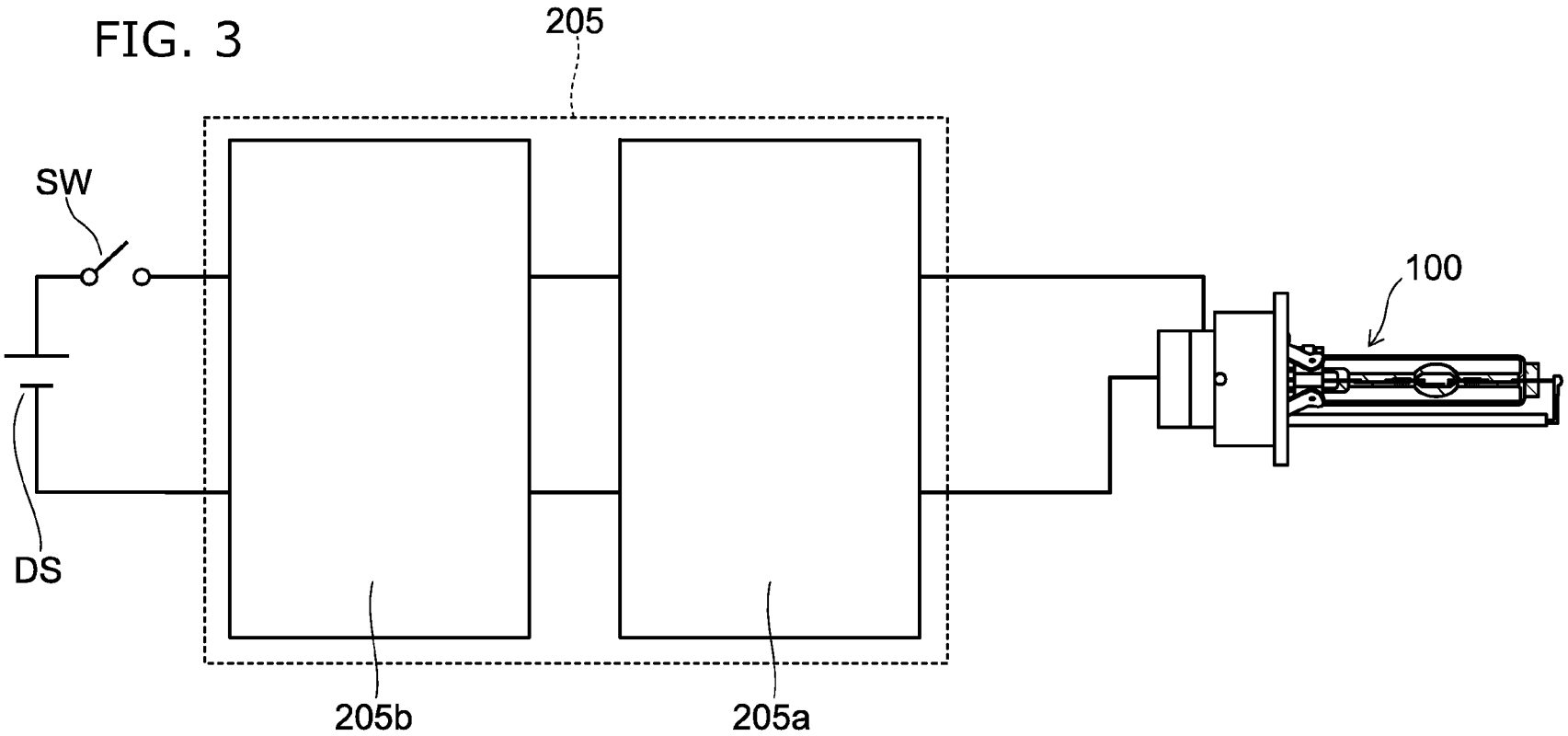
FIG. 3 is a schematic view for exemplifying a circuit of the vehicle lamp.

FIG. 3 is a schematic view for exemplifying a circuit of the vehicle lamp 200.

As shown in FIG. 2, the vehicle lamp 200 includes the discharge lamp 100, a reflector 202, a light shielding control plate 203, a lens 204 and a lighting circuit 205.

The reflector 202 reflects light irradiated from the discharge lamp 100 to the forward side. The reflector 202 is made of, for example, a metal having high reflectance. A space is provided inside the reflector 202, and an inner surface thereof has a parabola shape.

Ends of the reflector 202 at the forward side and the rearward side are opened.

The socket 102 of the discharge lamp 100 is attached to the vicinity of the opening of the reflector 202 at the rearward side. The burner 101 of the discharge lamp 100 is positioned in the inner space of the reflector 202.

The light shielding control plate 203 is provided inside the reflector 202, at the forward side of the burner 101 and at the downward side of the burner 101.

The light shielding control plate 203 is made of a light shielding material such as metal. The light shielding control plate 203 is provided to form a luminous intensity distribution called a cut line. The light shielding control plate 203 is movable, and changeover from a low beam to a high beam can be performed by tilting the light shielding control plate 203 downward.

The lens 204 is provided to close the opening of the reflector 202 at the forward side. The lens 204 is a convex lens. The lens 204 converges light directly incident from the discharge lamp 100 and light reflected by and incident from the reflector 202, and forms a desired luminous intensity distribution.

The lighting circuit 205 is a circuit for starting the discharge lamp 100 and keeping the lighting.

As shown in FIG. 3, the lighting circuit 205 includes, for example, an ignitor circuit 205*a* and a ballast circuit 205*b*.

A DC power supply DS such as a battery and a switch SW are electrically connected to the input side of the lighting circuit 205. The discharge lamp 100 is electrically connected to the output side of the lighting circuit 205.

The ignitor circuit 205*a* includes, for example, a transformer, a capacitor, a gap, a resistor and the like. The ignitor circuit 205*a* generates a high voltage pulse of about 30 kV, and applies the pulse to the discharge lamp 100. The high voltage pulse of about 30 kV is applied to the discharge lamp 100, so that the dielectric breakdown occurs between the pair of electrodes 32, and discharge occurs. That is, the ignitor circuit 205*a* starts the discharge lamp 100.

The ballast circuit 205*b* includes, for example, a DC/DC converter circuit, a DC/AC convertor circuit, a current and voltage detection circuit, a control circuit and the like. The ballast circuit 205*b* keeps the lighting of the discharge lamp 100 started by the ignitor circuit 205*a*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A discharge lamp comprising:

a light-emitting part including a discharge space therein in which a metal halide and a gas are sealed; and a pair of electrodes which protrude toward an inside of the discharge space and are arranged to face each other while separated by a specified distance, wherein:

power consumption at a time of stable lighting is 20 W or more and 30 W or less, and when a pressure of the gas sealed in the discharge space is X (atm) at room temperature (25° C.), and a distance between a center axis of the electrodes and an upper surface of the metal halide, when the discharge lamp is arranged horizontally, is m (mm), a following expression is satisfied: 0.085 (mm/atm)≤m/X≤0.12 (mm/atm), the distance being measured perpendicularly to the center axis of the electrodes.

2. The lamp according to claim 1, wherein a following expression is satisfied: 0.10 (mm/atm)≤m/X≤0.12 (mm/atm).

3. The lamp according to claim 1, wherein the gas sealed in the discharge space is a xenon gas or a mixed gas mainly including the xenon gas.

4. The lamp according to claim 3, wherein the mixed gas mainly including the xenon gas includes the xenon gas of 70 vol % or more.

5. The lamp according to claim 3, wherein the mixed gas mainly including the xenon gas includes the xenon gas and an argon gas.

6. The lamp according to claim 1, wherein the metal halide does not include mercury.

7. The lamp according to claim 1, wherein the metal halide includes one selected from a group consisting of sodium, scandium, zinc and indium.

8. The lamp according to claim 1, wherein the metal halide includes one selected from a group consisting of iodine, bromine and chlorine.

9. The lamp according to claim 1, wherein a distance between tip ends of the pair of electrodes is 3.7 mm or more and 4.4 mm or less.

10. The lamp according to claim 1, wherein a distance between and measured perpendicularly to the center axis of the electrodes and an inner wall of the light-emitting part is 0.9 mm or more and 1.2 mm or less.

11. The lamp according to claim 1, wherein the electrodes include one selected from a group consisting of thoriated tungsten, pure tungsten, doped tungsten and rhenium tungsten.

12. The lamp according to claim 1, further comprising an outer pipe provided outside the light-emitting part, wherein a gas capable of dielectric barrier discharge is sealed between the light-emitting part and the outer pipe.

13. The lamp according to claim 12, wherein the gas capable of dielectric barrier discharge is one selected from a group consisting of a neon gas, an argon gas, a xenon gas and a nitrogen gas.

14. The lamp according to claim 12, wherein a pressure of the gas sealed between the light-emitting part and the outer pipe is 0.3 atm or less.

15. The lamp according to claim 12, wherein the outer pipe has an ultraviolet ray shielding property.

16. The lamp according to claim 12, wherein the outer pipe includes one selected from a group consisting of titanium oxide, cerium oxide and aluminum oxide.

17. A vehicle lamp comprising:

a discharge lamp according to claim 1; and a lighting circuit electrically connected to the discharge lamp.

18. The lamp according to claim 17, wherein the discharge lamp is attached so that the pair of electrodes provided in the discharge lamp are horizontal.

19. The lamp according to claim 1, wherein the distance between the center axis of the electrodes and the upper surface of the metal halide is measured from a midpoint, in a horizontal direction, between the pair of electrodes.

* * * * *